US008113391B2

(12) United States Patent
Otsuka et al.

(10) Patent No.: US 8,113,391 B2
(45) Date of Patent: Feb. 14, 2012

(54) IMMERSION NOZZLE FOR CONTINUOUS CASTING

(75) Inventors: Hiroshi Otsuka, Kitakyushu (JP); Arito Mizobe, Kitakyushu (JP); Hisatake Okumura, Kitakyushu (JP); Masahide Yoshida, Kitakyushu (JP); Koji Kido, Kitakyushu (JP); Joji Kurisu, Kitakyushu (JP)

(73) Assignee: Krosaki Harima Corporation, Kitakyushu-shi (JP)

( * ) Notice: Subject to any disclaimer, the term of this patent is extended or adjusted under 35 U.S.C. 154(b) by 352 days.

(21) Appl. No.: 12/403,120

(22) Filed: Mar. 12, 2009

(65) Prior Publication Data

US 2009/0242592 A1 Oct. 1, 2009

(30) Foreign Application Priority Data

Mar. 27, 2008 (JP) ..... 2008-084166

(51) Int. Cl.
*B22D 41/00* (2006.01)
*B22D 41/50* (2006.01)

(52) U.S. Cl. ..... 222/591

(58) Field of Classification Search ..... 222/591; *B22D 11/10*

See application file for complete search history.

(56) References Cited

U.S. PATENT DOCUMENTS

| | | | |
|---|---|---|---|
| 4,949,778 | A | 8/1990 | Saito et al. |
| 2007/0102852 | A1 | 5/2007 | Richaud et al. |
| 2007/0158884 | A1 | 7/2007 | Tsukaguchi |

FOREIGN PATENT DOCUMENTS

| | | | |
|---|---|---|---|
| DE | 43 19 194 | A1 | 12/1994 |
| JP | 57-106456 | | 7/1982 |
| JP | 4-233658 | | 8/1992 |
| JP | 7-232247 | | 9/1995 |
| JP | 8-294757 | | 11/1996 |
| JP | 2001-347348 | | 12/2001 |
| WO | WO 2005/049249 | A2 | 6/2005 |

OTHER PUBLICATIONS

U.S. Appl. No. 12/400,358, Mar. 9, 2009, Kido, et al.

Office Action issued Dec. 24, 2010, in Chinese Patent Application No. 200910129821.4, filed Mar. 20, 2009 (with English-language translation).

Office Action mailed Jan. 24, 2011, in co-pending U.S. Appl. No. 12/400,358.

*Primary Examiner* — Jessica L Ward
*Assistant Examiner* — Alexander Polyansky
(74) *Attorney, Agent, or Firm* — Oblon, Spivak, McClelland, Maier & Neustadt, L.L.P.

(57) ABSTRACT

An immersion nozzle for continuous casting including a tubular body, the tubular body having at the upper end an inlet from which molten steel is introduced into a passage extending from the inlet downward inside the tubular body, the tubular body having a bottom and being depressed in cross section at least at a lower section, the lower section having two narrow sidewalls and two broad sidewalls, the narrow sidewalls having a pair of opposing first outlets communicating with the passage, the bottom having a pair of second outlets communicating with the passage. The lower section has ridges projecting into the passage respectively from the inner surfaces of the broad sidewalls between the pair of first outlets. The second outlets are arranged symmetrically about the axis of the tubular body such that the axes of the second outlets cross each other within the passage.

15 Claims, 17 Drawing Sheets

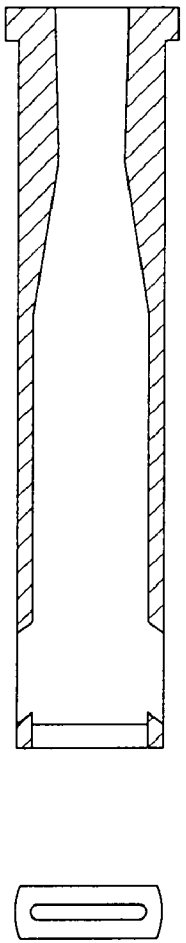
FIG. 11B
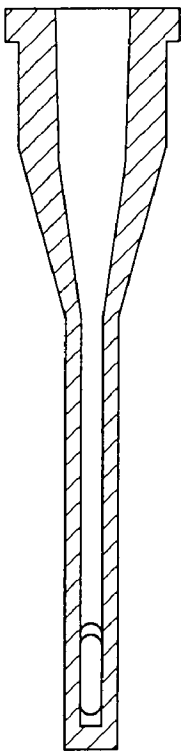
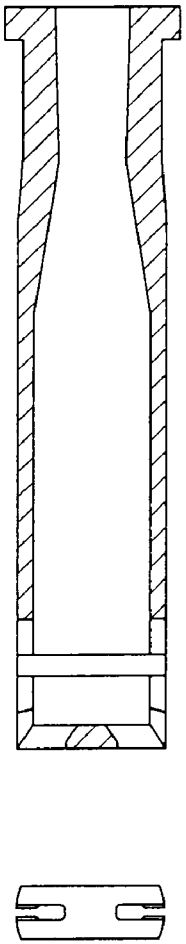
FIG. 11A
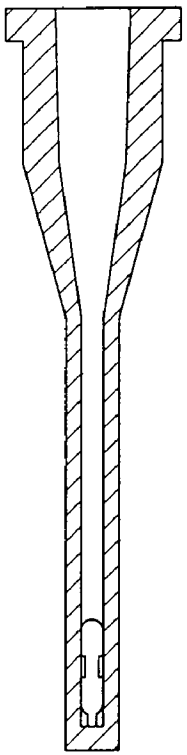

PRIOR ART

PRIOR ART

PRIOR ART

IMMERSION NOZZLE FOR CONTINUOUS CASTING

CROSS-REFERENCE TO RELATED APPLICATIONS

This application is based upon and claims the benefit of priority from Japanese Patent Application No. 2008-84166 filed on Mar. 27, 2008, the entire contents of which are incorporated herein by reference.

BACKGROUND OF THE INVENTION

1. Field of the Invention

The present invention relates to a continuous casting immersion nozzle for pouring molten steel from a tundish into a mold. More specifically, the present invention relates to an immersion nozzle used for high-speed casting of medium-thickness slabs (about 70 mm to about 150 mm thick).

2. Description of the Related Art

With the trend toward faster continuous casting aimed at increasing productivity of slabs, Japanese Unexamined Patent Application Publication No. 57-106456, for example, discloses as an immersion nozzle that advantageously fits increasing throughputs of casting steel products, an immersion nozzle having a plurality of small holes disposed in the bottom (See FIG. 15). The immersion nozzle may be used with no difficulty in continuous casting when the throughput of cast slabs (pouring rate) is 1 m/min to 1.5 m/min.

Japanese Unexamined Patent Application Publication No. 7-232247 discloses an immersion nozzle for continuous casting including a cylindrical body, the body having a pair of outlets disposed in the sidewall of a lower section thereof and a slit opening formed in a downwardly tapered lower section thereof. The outlets and slit opening are designed to decrease defects in the cast steel products caused by entrapment of inclusions (See FIG. 16A, FIG. 16B). In this immersion nozzle, the bottom is fully opened with the slit opening to make a large open area.

International Publication No. 2005/049249 discloses an immersion nozzle including a tubular body, the body having a pair of opposing lateral outlets in the sidewall of a lower section thereof. The lateral outlets each are divided by one or two inward horizontal projections into two or three vertically arranged portions to make a total of four or six outlets (See FIG. 17A, FIG. 17B). The publication describes that the immersion nozzle permits inhibition of clogging and generation of more stable and controlled exit-streams which are more uniform in velocity and in which spin and swirl are significantly reduced.

In the conventional immersion nozzles that have a pair of outlets disposed in the lower sidewall of the tubular body, larger amounts of the exit-streams issue from the lower portions of the outlets, which results in imbalance in amounts between the exit-streams that issue from the lower portions and the exit-streams that issue from the upper portions of the outlets. With a rise in the throughput, this imbalance increases to form negative pressure in the upper portions of the outlets, thereby possibly allowing the molten steel in the mold to flow into the nozzle through the upper portions of the outlets. This leads to excessive velocities of part of the molten steel streams impinging on the narrow sidewalls of the mold, which in turn causes increased velocities of the reverse flows that impinge on the narrow sidewalls and turn back. The increased velocities of the reverse flows raise the level fluctuation at the surface of the molten steel in the mold, resulting in asymmetric streams on the right- and left-hand sides of the immersion nozzle.

The present invention has been made in view of the above circumstances, and it is an object of the present invention to provide an immersion nozzle for continuous casting, particularly for high-speed continuous casting of medium-thickness slabs, which nozzle permits a reduction in the drift of molten steel flow in the mold and a reduction in the level fluctuation at the surface of the molten steel to improve the quality and productivity of slabs.

SUMMARY OF THE INVENTION

The present invention provides an immersion nozzle for continuous casting. The immersion nozzle has a tubular body with a bottom. The tubular body has an inlet for entry of molten steel disposed at an upper end and a passage to extend downward from the inlet. The tubular body is depressed in cross section at least at a lower section. The lower section has two narrow sidewalls and two broad sidewalls. A pair of opposing first outlets are disposed in the narrow sidewalls of the lower section so as to communicate with the passage. The lower section has ridges horizontally projecting into the passage from inner surfaces of the broad sidewalls between the pair of first outlets. Additionally, a pair of second outlets are disposed in the bottom so as to communicate with the passage, and are disposed symmetrically about an axis of the tubular body. The axes of the pair of second outlets cross each other in the passage.

In the immersion nozzle according to the present invention, it is preferable that a/a' ranges from 0.1 to 0.25 and b/b' ranges from 0.15 to 0.35, where a' is a horizontal width of the first outlets; b' is a vertical length of the first outlets; a is a projection height of the ridges; and b is a vertical width of the ridges.

Also, it is preferable that f/a' ranges from 0.75 to 0.9, e/e' ranges from 0.1 to 0.17, and $\alpha$ ranges from 40° to 60°, where f is a length of the second outlets along the narrow sidewalls; $\alpha$ is an angle formed between each of the axes of the second outlets and the horizontal plane; e is a minimum internal measurement between the pair of second outlets; and e' is a width of the passage, along the broad sidewalls, immediately above the first outlets.

Further, the immersion nozzle according to the present invention may further include slits for allowing communication between the first outlets and the second outlets to make the exit-streams more balanced. In this respect, it is preferable that d/a' ranges from 0.2 to 1, where d is the width of the slits.

BRIEF DESCRIPTION OF THE DRAWINGS

FIG. 11A is a view explaining a simulation model, used in fluid analysis, of the immersion nozzle according to the embodiment of the present invention.

FIG. 11B is a view explaining a simulation model, used in fluid analysis, of an immersion nozzle according to prior art.

DETAILED DESCRIPTION OF THE PREFERRED EMBODIMENTS

Figure 1A:
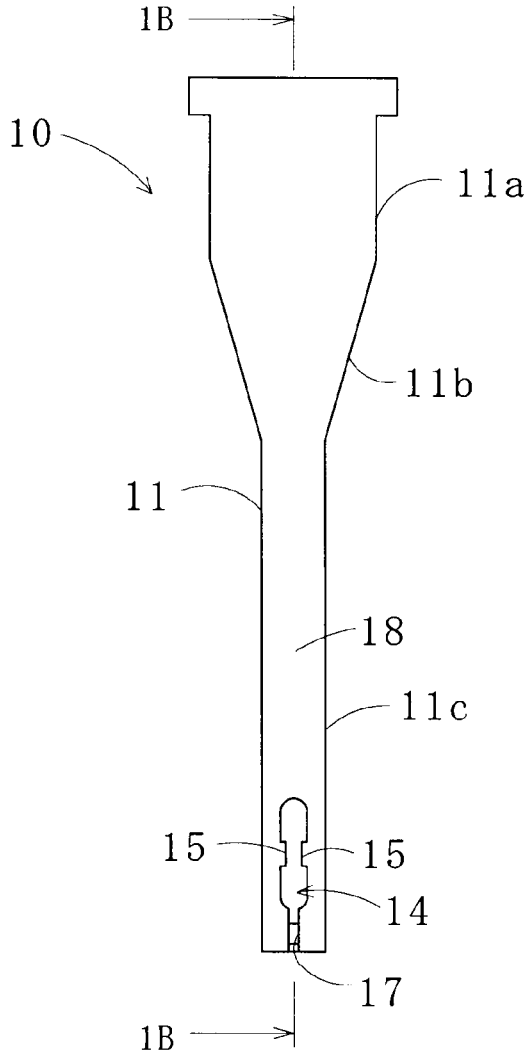
FIG. 1A shows an immersion nozzle for continuous casting according to one embodiment of the present invention.
Figure 1B:
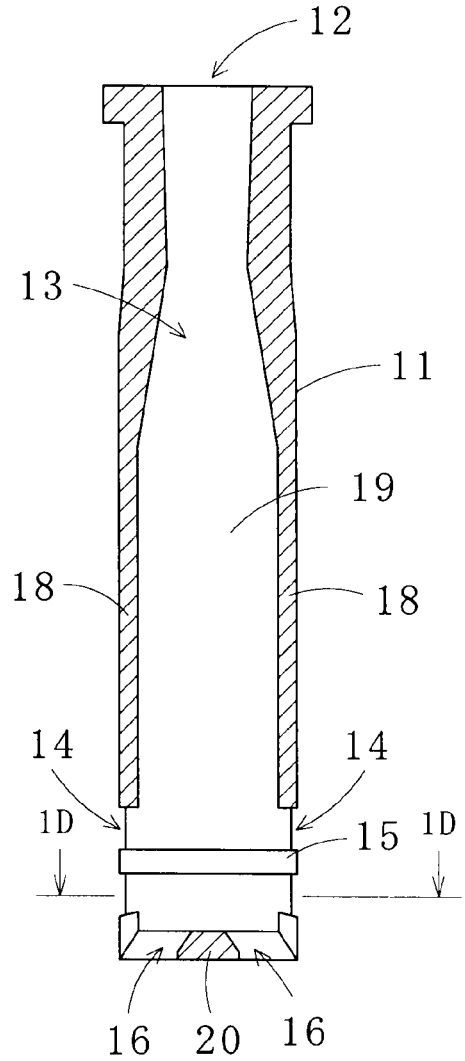
FIG. 1B is a cross-sectional view taken on line 1B-1B of FIG. A.
Figure 1C:
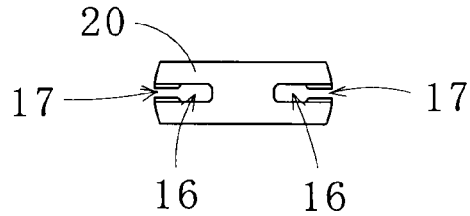
FIG. 1C is a bottom view of the immersion nozzle for continuous casting.
Figure 1D:
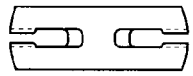
FIG. 1D is a cross-sectional view taken on line 1D-1D of FIG. 1B.

FIG. 1A shows an immersion nozzle 10 for continuous casting according to one embodiment of the present invention. Throughout the specification, the directions are set with the immersion nozzle 10 arranged upright.

The immersion nozzle 10 according to the present embodiment includes a tubular body 11 with a bottom 20. The tubular body 11 has a cylindrical upper section 11*a*, a lower section 11*c* of a depressed cross section, and a taper section 11*b* that is tapered when seen in side view and that connects the upper section 11*a* and the lower section 11*c*. The upper section 11*a* has at the upper end an inlet 12 from which a passage 13 extends downward through the tubular body 11.

The lower section 11*c* of a depressed cross section has opposing narrow sidewalls 18, 18 and opposing broad sidewalls 19, 19. The narrow sidewalls 18, 18 have respectively opposing first outlets 14, 14 disposed at positions close to the bottom 20 so as to communicate with the passage 13. The first outlets 14, 14 are vertically elongated slots.

The broad sidewalls 19, 19 have respectively opposing horizontal ridges 15, 15 that project from inner surfaces thereof into the passage 13 between the pair of first outlets 14, 14. The ridges 15, 15 are of a substantially rectangular cross section. The term "substantially rectangular cross section" is intended to cover a rectangular cross section with rounded corners. When seen in a view showing the narrow sidewall 18 in front, the first outlet 14 is constricted in the middle.

The ridges 15, 15 reduce the excessive velocities of streams of molten steel in the lower portions of the first outlets 14, 14, and also the ridges 15, 15 significantly reduce the amount of the molten steel that flows from a mold into the immersion nozzle 10 through the upper portions of the first outlets 14, 14. Further, the ridges 15, 15 lower the maximum velocities of molten steel streams that impinge on the narrow sidewalls of the mold, and thus decreases the velocities of the reverse flows thereby to reduce the level fluctuation at the surface of the molten steel, providing more symmetric streams on the right- and left-hand sides of the immersion nozzle 10.

The tubular body 11 has a pair of second outlets 16, 16 disposed in the bottom 20 so as to communicate with the passage 13. The second outlets 16, 16 are arranged symmetrically about the axis of the tubular body 11 such that the axes 24, 24 of the respective second outlets 16, 16 cross each other within the passage 13. The second outlets 16, 16 are in a truncated inverted V arrangement when the tubular body 11 is vertically cut along the broad sidewall of the lower section thereof.

In the immersion nozzle 10 according to the present embodiment, the first outlets 14, 14 are allowed to communicate with the second outlets 16, 16 by vertically extending slits 17, 17 disposed in the narrow sidewalls 18, 18, respectively.

Water model tests were performed using models of the immersion nozzle 10 in order to determine the optimum configurations of the first outlets 14, 14, the second outlets 16, 16, and the slits 17, 17. The water model tests performed will be described in the below.

Figure 2:
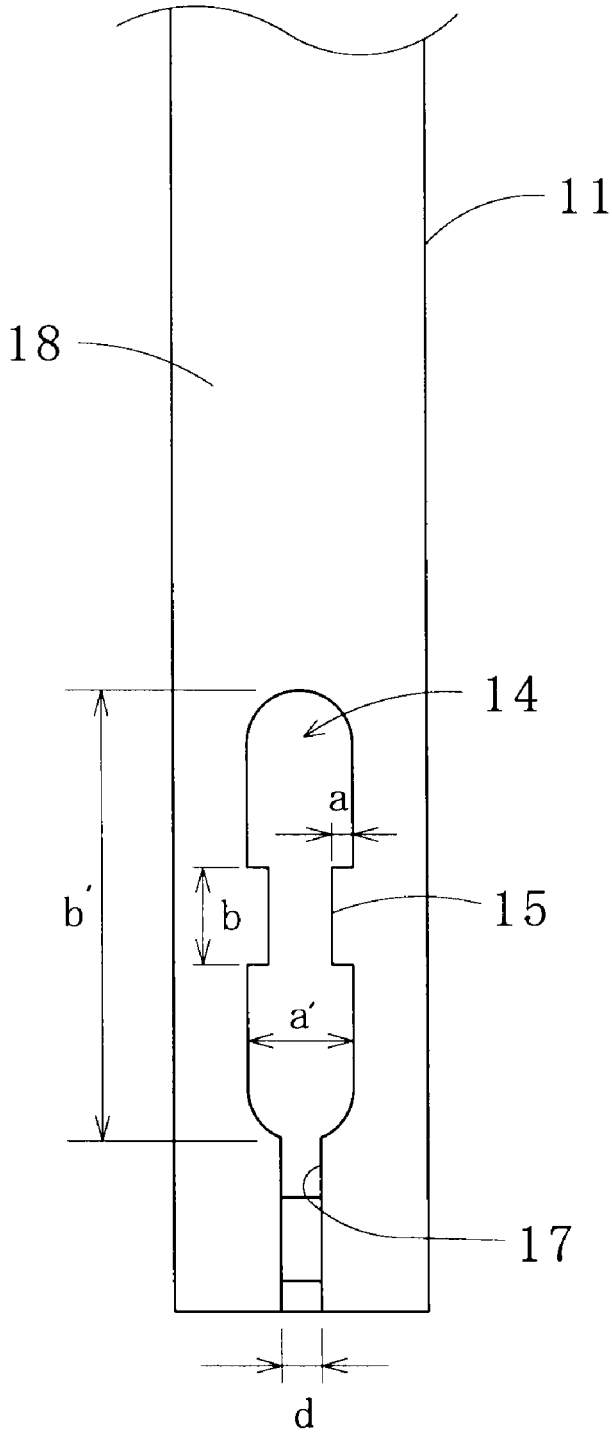
FIG. 2 is a partial side view of the immersion nozzle.
Figure 3:
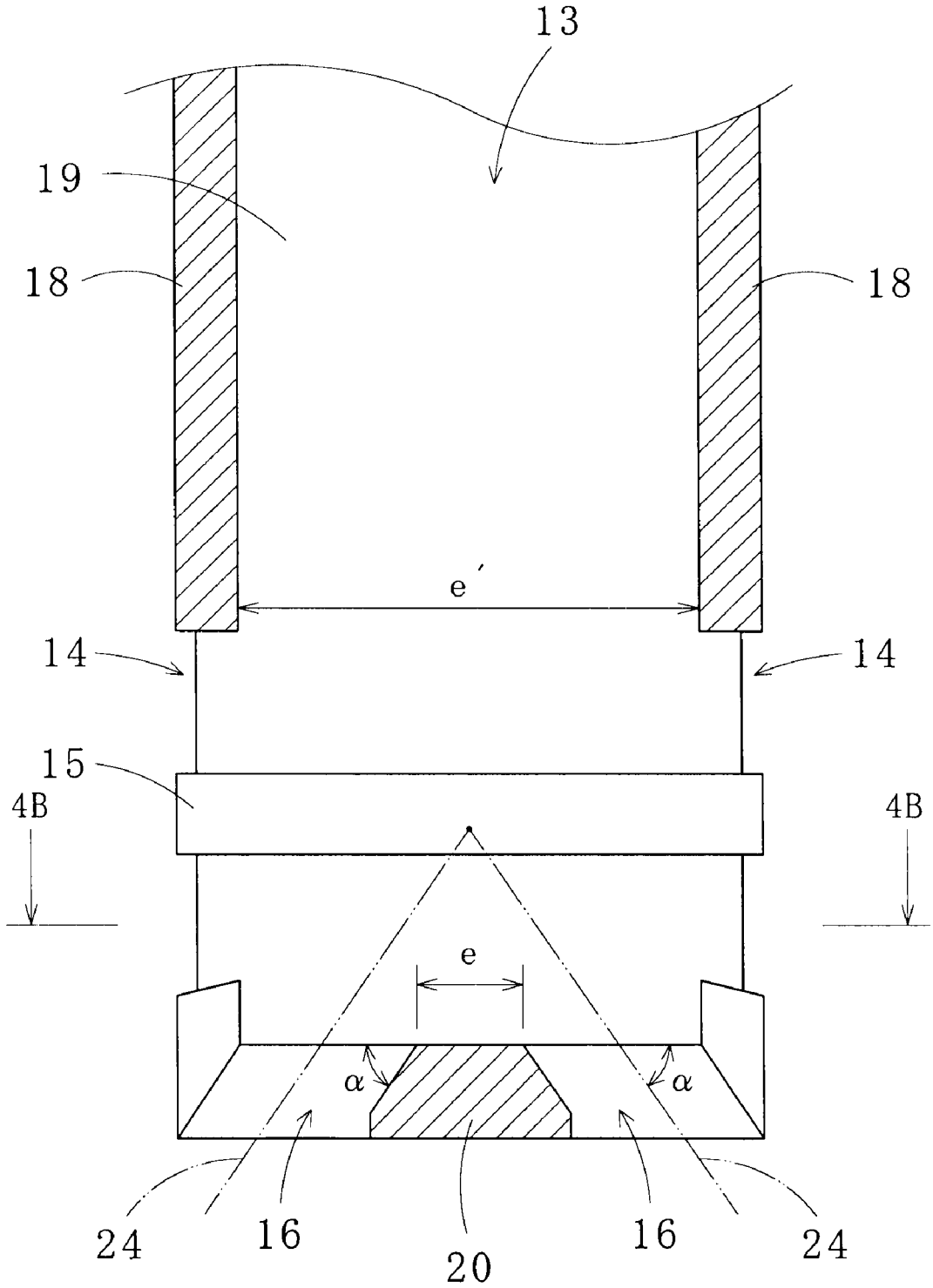
FIG. 3 is a partial vertical sectional view of the immersion nozzle, taken along the broad sidewall of a lower section thereof.
Figure 4A:
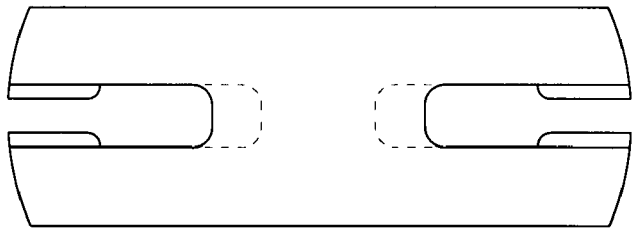
FIG. 4A is a bottom view of the immersion nozzle.
Figure 4B:
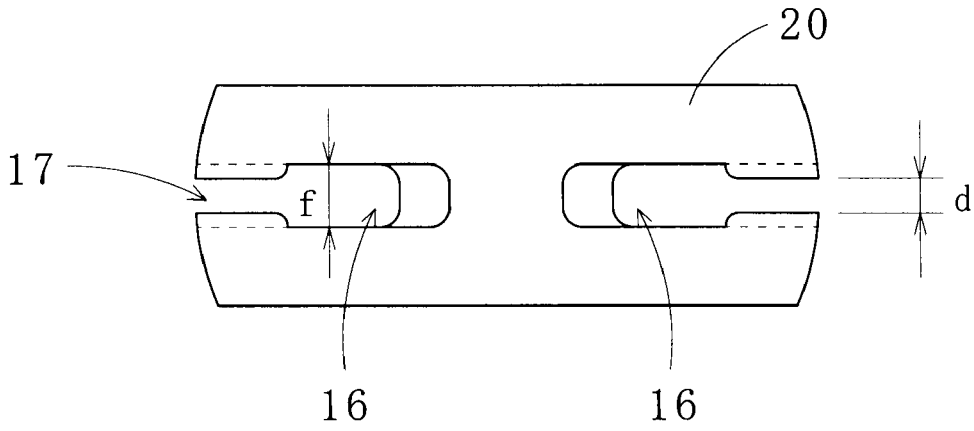
FIG. 4B is a cross-sectional view taken on line 4B-4B of FIG. 3.

Parameters used to determine the optimum configurations of the outlets and slits are denoted as follows. The horizontal width of the first outlets 14, 14 is denoted as a', the vertical length of the first outlets 14, 14 is denoted as b', the projection height of the ridges 15, 15 is denoted as a, and the vertical width of the ridges 15, 15 is denoted as b (See FIG. 2). The length of the second outlets 16, 16 in a direction of the short side is denoted as f, the angle formed between each of the axes 24, 24 of the second outlets 16, 16 and the horizontal plane is denoted as α, the minimum internal measurement between the second outlets 16, 16 is denoted as e, and the width of the passage 13 in a direction of the long side immediately above the first outlets 14, 14 is denoted as e' (See FIG. 3, FIG. 4B). The width of the slits 17, 17 is denoted as d (See FIG. 2, FIG. 4B).

Figure 5:
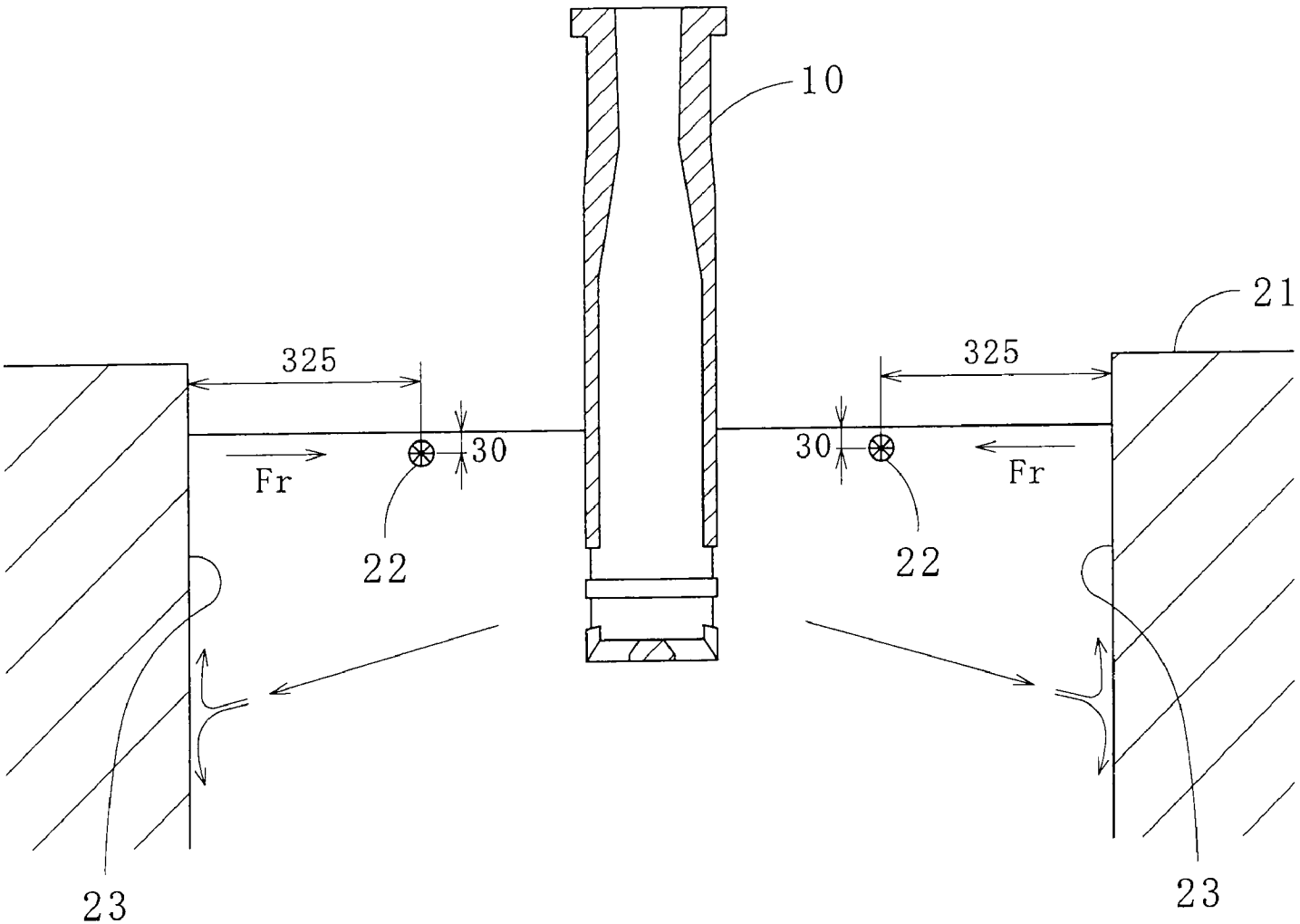
FIG. 5 is a schematic view for explaining water model tests performed using models of the immersion nozzle according to the embodiment of the present invention.

FIG. 5 is a schematic view for explaining the water model tests.

A 1/1 scale mold 21 was made of an acrylic resin. The mold 21 was dimensioned such that the length of the long sides (in FIG. 5, in the left-right direction) was 1300 mm and that the length of the short sides (in FIG. 5, in a direction perpendicular to the paper surface) was 100 mm. Water was circulated through the immersion nozzle 10 and the mold 21 by means of a pump at a rate equivalent to a throughput of 4.4 m/min.

The immersion nozzle 10 was placed in the center of the mold 21 such that the long sides of the depressed cross section were parallel to the long sides of the mold 21. Propeller-type flow speed detectors 22, 22 were installed 325 mm (¼ of the length of the long sides of the mold 21) off narrow sidewalls 23, 23, respectively, of the mold 21 and 30 mm deep from the water surface. Then, the velocities of the reverse flows Fr, Fr were measured.

The results of the water model tests will be described below. For the tests, an envisaged basic model was dimensioned as follows. In each test, only a dimension serving as a target parameter was varied and the other dimensions were made to have the fixed values of corresponding dimensions of the basic model.

Figure 6:
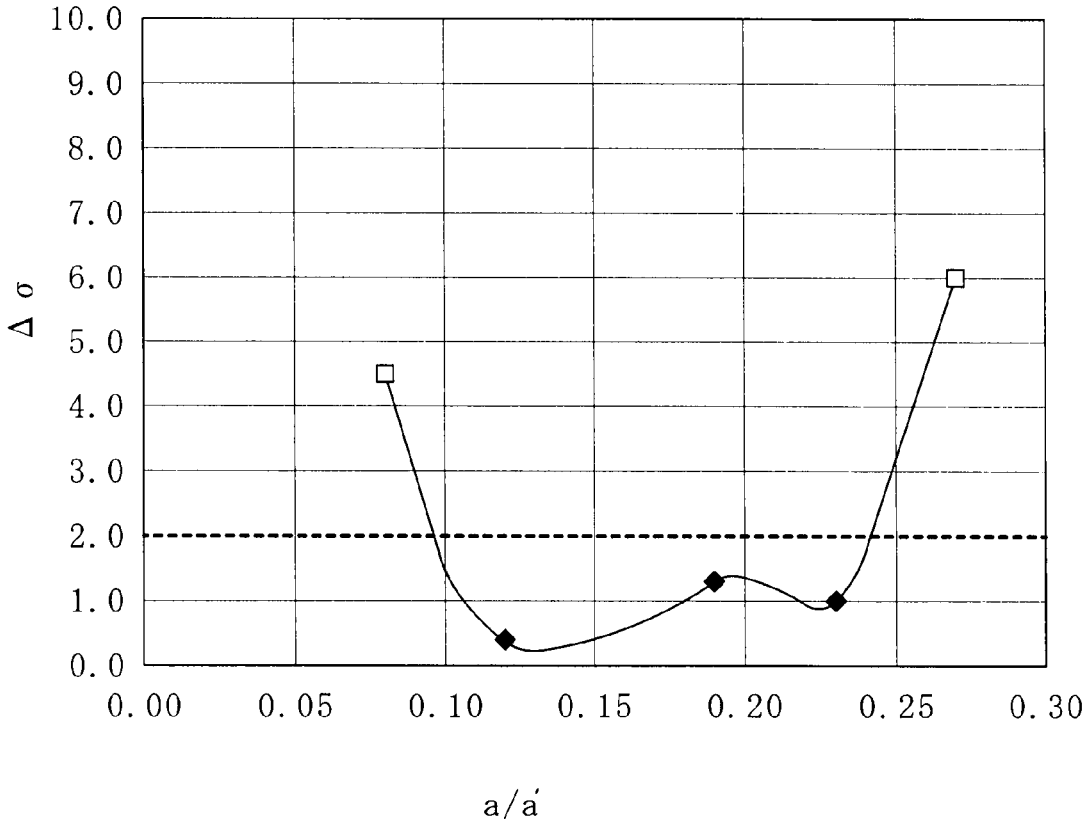
FIG. 6 shows a graph of the relationship between a/a' and Δσ of the immersion nozzle according to the embodiment of the present invention.

Dimensions of the basic model: a=5 mm, a'=26 mm, b=25 mm, b'=115 mm, f=23 mm, e=26 mm, e'=143 mm, $\alpha$=60°, d=10 mm FIG. 6 shows a graph that represents the correlation between a/a' and $\Delta\sigma$. Here, $\Delta\sigma$ is a difference between standard deviations, of the velocities of the right- and left-hand reverse flows Fr, Fr, calculated using data obtained by measuring the velocities of the reverse flows Fr, Fr for three minutes by means of the flow speed detectors 22, 22, as shown in FIG. 5. As $\Delta\sigma$ increases, the difference becomes wider between the velocities of the right- and left-hand reverse flows Fr, Fr. In the present invention, either 4 cm/sec or 2 cm/sec was taken as the critical value of $\Delta\sigma$. When $\Delta\sigma$ was less than 4 cm/sec, it was confirmed through visual observation in the water model tests that the discharge angles of the respective right- and left-hand exit-streams to the horizontal plane were substantially the same. When $\Delta\sigma$ was less than 2 cm/sec, not only the discharge angles of the respective right- and left-hand exit-streams to the horizontal plane were substantially the same, but Karman vortexes did not occur which would have otherwise periodically generated between the broad sidewalls of the mold 21 and the immersion nozzle 10. Karman vortexes induce local entrapment of mold powder, giving rise to problems.

FIG. 6 indicates that $\Delta\sigma$ was 2 cm/sec or less when a/a' ranged from 0.1 to 0.25, and that the exit-streams in the mold were balanced. When a/a' was less than 0.1, the ridges did not fully exhibit the effect of interrupting the flow, and the exit-streams in the lower portions of the first outlets had excessive velocities, to make the right- and left-hand streams in the mold 21 extremely asymmetric. On the other hand, when a/a' was beyond 0.25, the exit-streams in the lower portions of the first outlets had slightly too low velocities, namely, the exit-streams in the upper portions of the first outlets had excessive velocities, to increase the velocities of the reverse flows Fr, Fr at the water surface in the mold 21, thereby causing adverse effects such as entrapment of mold powder.

Figure 7:
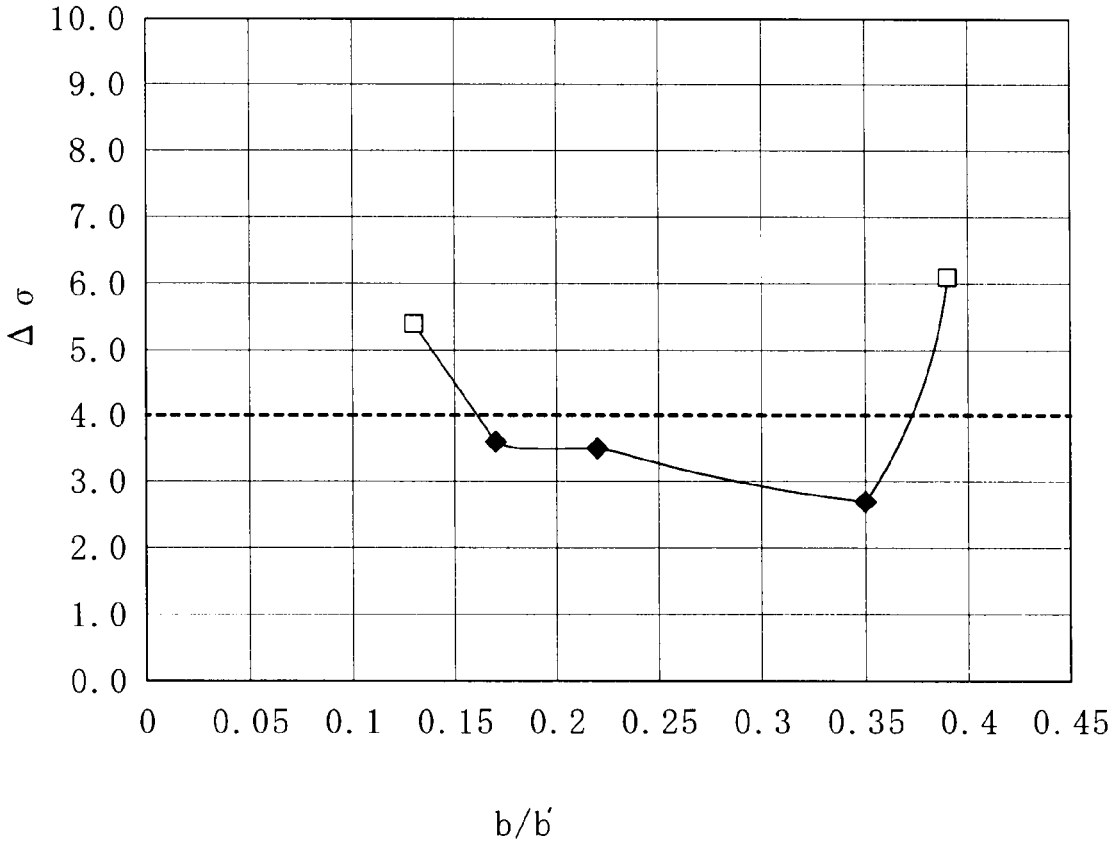
FIG. 7 shows a graph of the relationship between b/b' and Δσ of the immersion nozzle according to the embodiment of the present invention.

FIG. 7 shows the correlation between b/b' and $\Delta\sigma$. FIG. 7 indicates that $\Delta\sigma$ was 4 cm/sec or less when b/b' ranged from 0.15 to 0.35. When b/b' was less than 0.15, the ridges did not fully exhibit the effect of interrupting the flow, and the exit-streams in the lower portions of the first outlets had excessive velocities, to form extremely asymmetric right- and left-hand streams in the mold 21. On the other hand, when b/b' was beyond 0.35, the exit-streams in the lower portions of the first outlets had slightly too low velocities, namely, the exit-streams in the upper portions of the first outlets had excessive velocities, to increase the velocities of the reverse flows Fr, Fr at the water surface in the mold 21 and to give adverse effects such as entrapment of mold powder. It is desirable to dispose the ridges at positions to divide the first outlets each into two equal portions vertically arranged in order to balance the velocities of the exit-streams from the lower portions of the first outlets and the velocities of the exit-streams from the upper portions of the first outlets.

Figure 8:
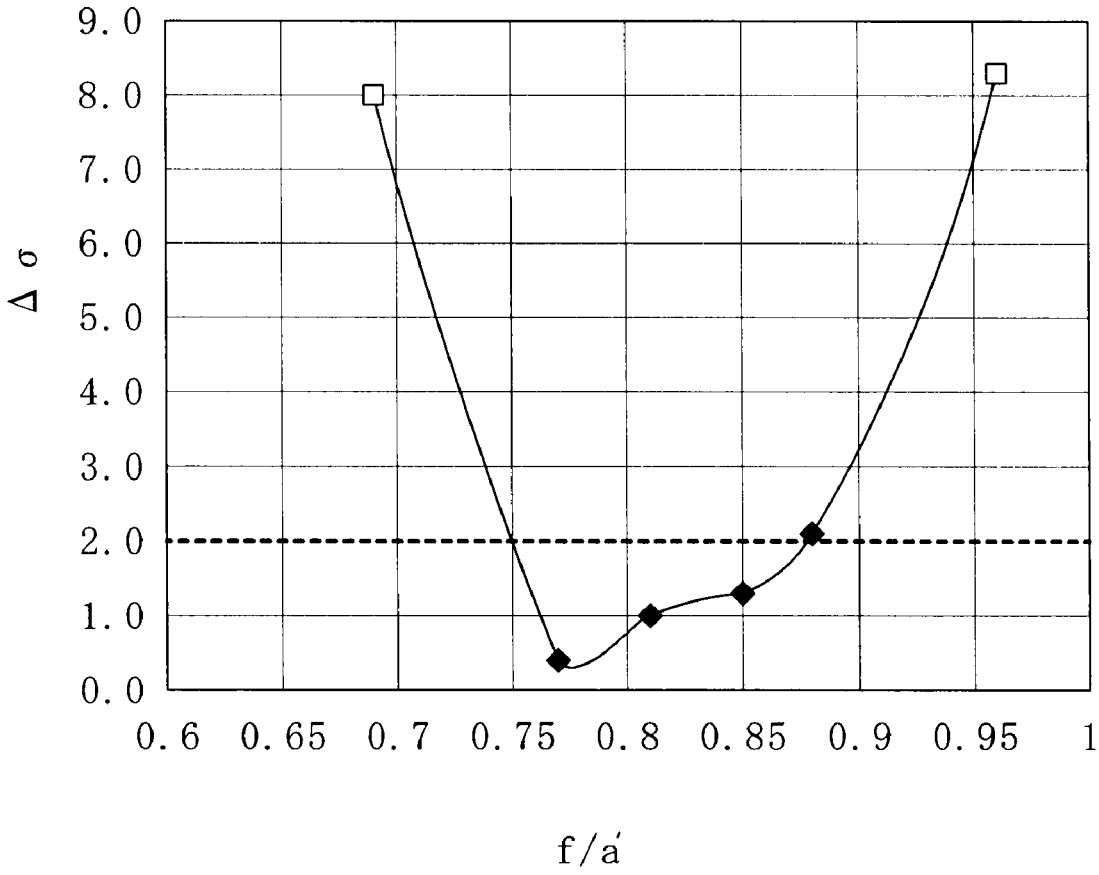
FIG. 8 shows a graph of the relationship between f/a' and Δσ of the immersion nozzle according to the embodiment of the present invention.

FIG. 8 shows a graph that represents the correlation between f/a' and $\Delta\sigma$. FIG. 8 indicates that $\Delta\sigma$ was 2 cm/sec or less when f/a' ranged from 0.75 to 0.9. When f/a' was less than 0.75, the width f of the second outlets 16, 16 was too small relative to the length a' of the first outlets 14, 14, and thus insufficient amounts of the exit-streams were discharged from the second outlets to result in excessive velocities of the reverse flows Fr, Fr at the water surface in the mold 21, thereby causing adverse effects such as entrapment of mold powder. On the other hand, when f/a' was beyond 0.9, excessive amounts of the exit-streams were discharged from the second outlets, namely, insufficient amounts of the exit-streams were discharged from the first outlets, to make the entire flow in the mold 21 unstable. This results in the level fluctuation at the water surface and the asymmetric right- and left-hand streams in the mold 21.

Figure 9:
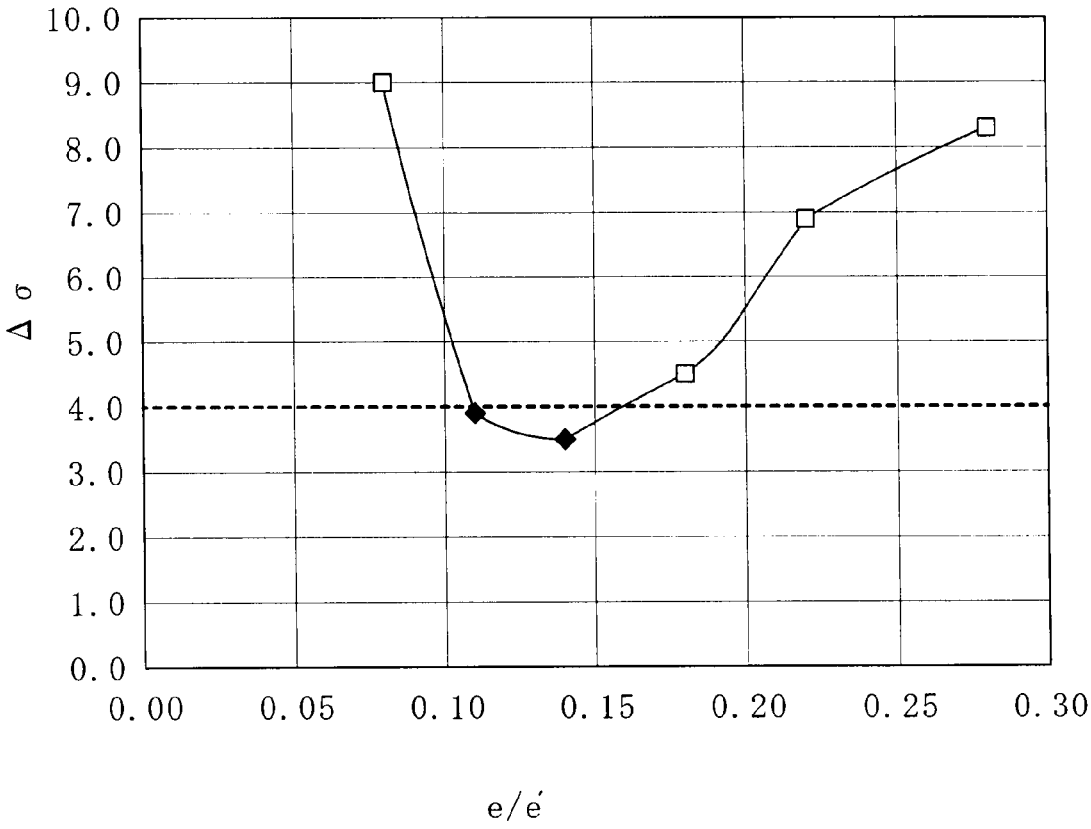
FIG. 9 shows a graph of the relationship between e/e' and Δσ of the immersion nozzle according to the embodiment of the present invention.

FIG. 9 shows a graph that represents the correlation between e/e' and $\Delta\sigma$. FIG. 9 indicates that $\Delta\sigma$ was 4 cm/sec or less when e/e' ranged from 0.1 to 0.17. When e/e' was less than 0.1, excessive amounts of the exit-streams were discharged from the second outlets, and insufficient amounts of the exit-streams were discharged from the first outlets, to make the entire flows in the mold 21 unstable. This results in the level fluctuation at the water surface and the asymmetric right- and left-hand streams in the mold 21. On the other hand, when e/e' was beyond 0.17, the length of the second outlets 16, 16 was too short relative to the width e' of the passage 13, and thus insufficient amounts of the exit-streams were discharged from the second outlets, which caused excessive velocities of the reverse flows Fr, Fr at the water surface in the mold 21, thereby causing adverse effects such as entrapment of mold powder.

Though there is no presentation in the drawings on the test results about the angle $\alpha$ formed between each of the axes of the second outlets 16, 16 and the horizontal plane, it was confirmed that $\Delta\sigma$ was minimum when $\alpha$ was 40° to 60°. When $\alpha$ was less than 40°, the exit-streams from the second outlets were synchronized with the exit-streams from the first outlets to increase the velocities of the reverse flows Fr, Fr at the water surface in the mold 21, thereby causing adverse effects such as entrapment of mold powder. Further, since the dimensions of the second outlets were relatively decreased, the exit-streams from the second outlets had increased velocities to raise the velocities of the reverse flows Fr, Fr and thereby to extremely increase the level fluctuation at the water surface. On the other hand, when $\alpha$ was beyond 60°, the exit-streams from the pair of second outlets joined together to make a flow that wandered unstably like a pendulum, resulting in $\Delta\sigma$ of beyond 4 cm/sec, which was not desirable.

Figure 10:
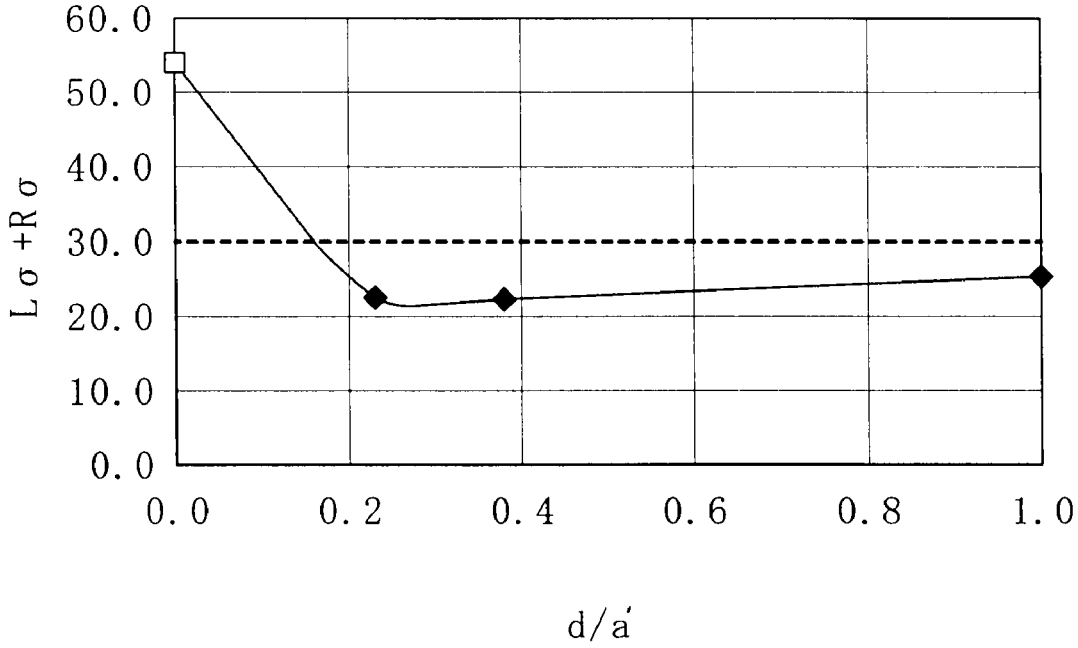
FIG. 10 shows a graph of the relationship between d/a' and Lσ+Rσ0 of the immersion nozzle according to the embodiment of the present invention.

FIG. 10 shows a graph that represents the correlation between d/a' and $L\sigma+R\sigma$. In this graph, $L\sigma$ is a standard deviation of the velocity of the left-hand reverse flow Fr; $R\sigma$ is a standard deviation of the velocity of the right-hand reverse flow Fr; and $L\sigma+R\sigma$ is the sum of the standard deviations of the velocities of the right- and left-hand reverse flows Fr, Fr. Throughout the tests performed, all the values of $\Delta\sigma$ obtained were below 2 cm/sec, and thus $L\sigma+R\sigma$ was used as an evaluation criterion. FIG. 10 indicates that $L\sigma+R\sigma$ was 30 cm/sec or less when d/a' ranged from 0.2 to 1. When d/a' was less than 0.2, the reverse flows Fr, Fr had excessive velocities to cause adverse effects such as entrapment of mold powder. On the other hand, there occurred problems such as cracks at the lower end of the immersion nozzle due to strength poverty when d/a' was beyond 1.

A description will be made regarding the fluid analyses on the amounts of exit-streams from the immersion nozzle for continuous casting according to the embodiment of the present invention and those from an immersion nozzle according to prior art.

Figure 12A:
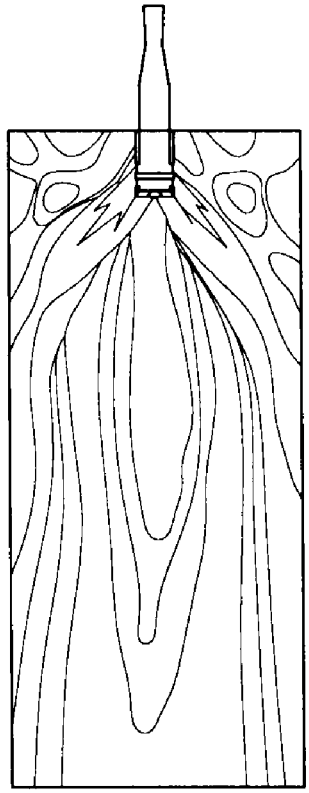
FIG. 12A is a view showing the results of fluid analysis performed using the simulation model of the immersion nozzle according to the embodiment of the present invention, the flow rate being 4.0 m/min.
Figure 12B:
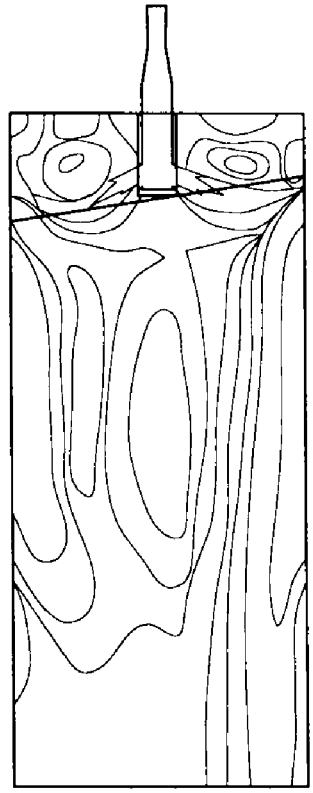
FIG. 12B is a view showing the results of fluid analysis performed using the simulation model of the immersion nozzle according to the prior art, the flow rate being 4.0 m/min.
Figure 13A:
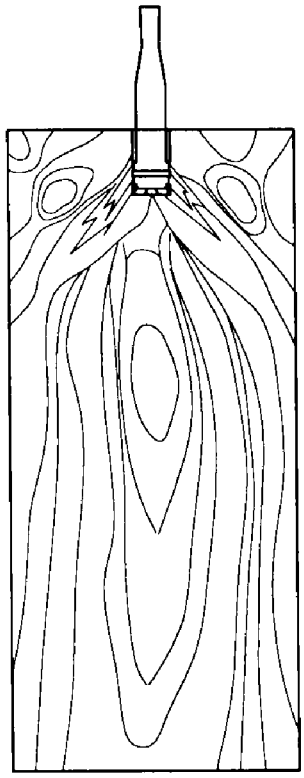
FIG. 13A is a view showing the results of fluid analysis performed using the simulation model of the immersion nozzle according to the embodiment of the present invention, the flow rate being 4.4 m/min.
Figure 13B:
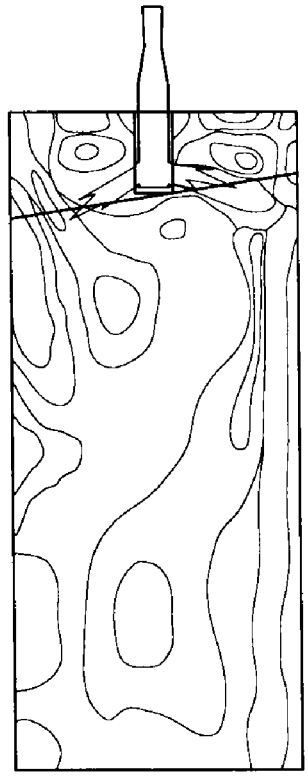
FIG. 13B is a view showing the results of fluid analysis performed using the simulation model of the immersion nozzle according to the prior art, the flow rate being 4.4 m/min.
Figure 14A:
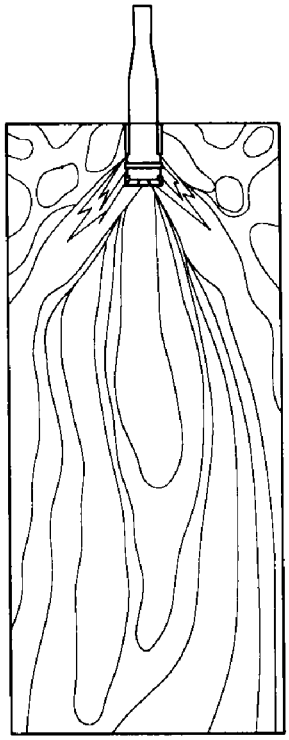
FIG. 14A is a view showing the results of fluid analysis performed using the simulation model of the immersion nozzle according to the embodiment of the present invention, the flow rate being 4.8 m/min.
Figure 14B:
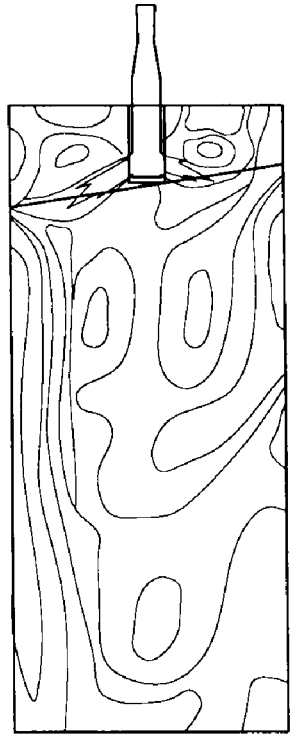
FIG. 14B is a view showing the results of fluid analysis performed using the simulation model of the immersion nozzle according to the prior art, the flow rate being 4.8 m/min.
Figure 15:
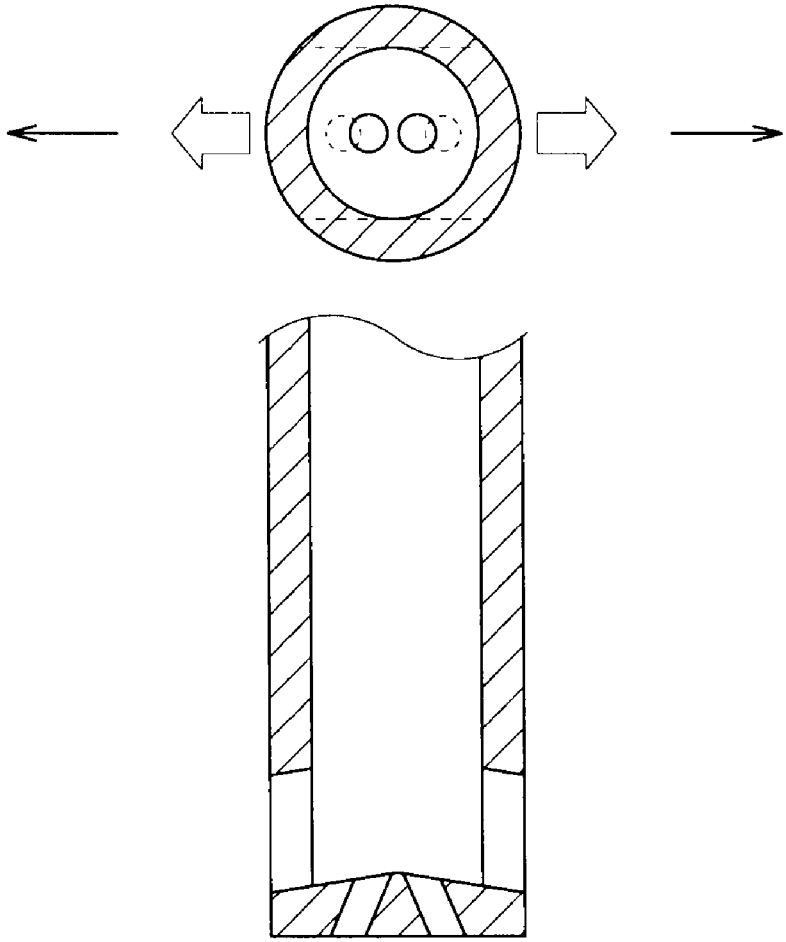
FIG. 15 is a cross sectional view of an immersion nozzle for continuous casting according to Japanese Unexamined Patent Application Publication No. 57-106456.
Figure 16A:
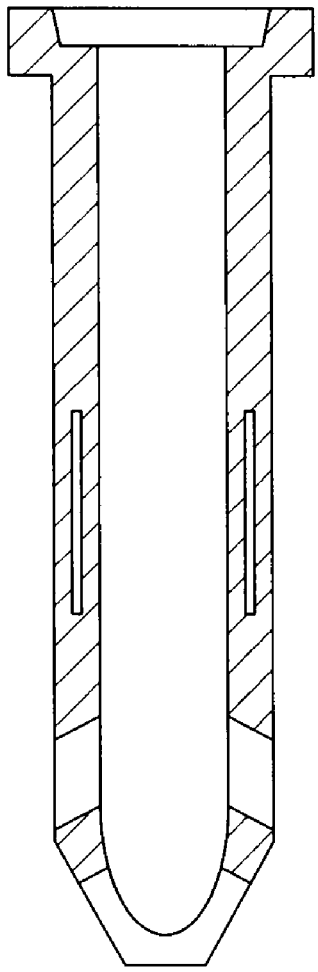
FIG. 16A and FIG. 16B are cross sectional views of an immersion nozzle for continuous casting according to Japanese Unexamined Patent Application Publication No. 7-232247.
Figure 16B:
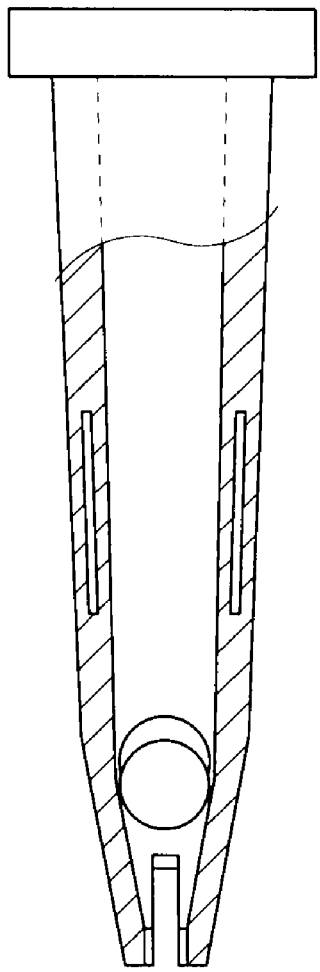
Figure 17A:
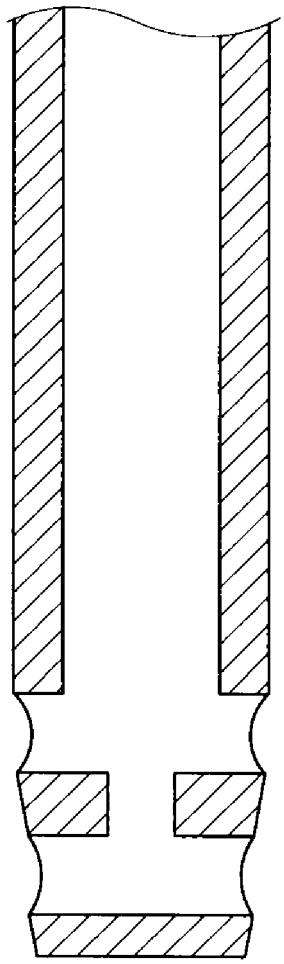
FIG. 17A and FIG. 17B are cross sectional views of an immersion nozzle for continuous casting according to International Publication No. 2005/049249.
Figure 17B:
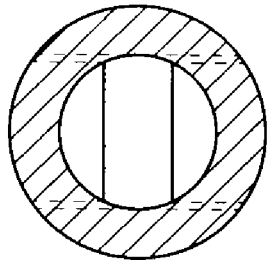

The fluid analyses were performed by using FLUENT (fluid analysis software) manufactured by Fluent Asia Pacific Co., Ltd (i.e., ANSYS Japan K.K. at present). FIGS. 11A and 11B show simulation models used for the fluid analyses. FIG. 11A shows a simulation model of the nozzle according to the embodiment of the present invention, while FIG. 11B shows a simulation model of a nozzle according to prior art. FIGS. 12A, 13A and 14A show the results of fluid analyses performed using the model shown in FIG. 11A, while FIGS. 12B, 13B and 14B show the results of fluid analyses performed using the model shown in FIG. 11B. The model according to the prior art includes a tubular body having a passage inside and depressed in cross section at least at a lower section thereof. In this model, a pair of first opposing outlets are disposed in the narrow sidewalls of the lower section and communicate with the passage, and a second outlet which communicate with the passage is formed in the bottom of the tubular body in a manner to fully open the bottom. Table 1 presents the parameters of each simulation model.

The analyses were performed on the assumption that the mold was 1300 mm long and 100 mm wide; the throughputs were 4.0 m/min (FIG. 12A, FIG. 12B), 4.4 m/min (FIG. 13A, FIG. 13B) and 4.8 m/min (FIG. 14A, FIG. 14B); and the nozzle immersion depth was 303 mm.

TABLE 1

| Parameter | Embodiment of Present Invention | Prior Art |
|---|---|---|
| a/a' | 0.19 | — |
| b/b' | 0.20 | — |
| f/a' | 0.88 | — |
| e/e' | 0.14 | 1.00 |
| α | 55° | — |
| d/a' | 0.4 | — |

FIGS. 12A, 12B, 13A, 13B, 14A, and 14B present the results of the analyses. These figures indicate the following. In the case of the immersion nozzle according to the prior art, the right- and left-hand streams were asymmetric and the reverse flows had high velocities, causing the risk of the entrapment of mold powder and the level fluctuation at the molten steel surface. On the other hand, in the case of the immersion nozzle according to the embodiment of the present invention, the right- and left-hand streams were substantially symmetric and the reverse flows had velocities in a desirable range to reduce the level fluctuation at the molten steel surface and to improve the quality and productivity of the slabs.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An immersion nozzle for continuous casting comprising:

a tubular body with a bottom, the tubular body having an inlet for entry of molten steel disposed at an upper end and a passage extending downward from the inlet and being depressed in cross section at least at a lower section, the lower section having two narrow sidewalls and two broad sidewalls, the broad sidewalls being wider than the narrow sidewalls;

a pair of opposing first outlets disposed in the narrow sidewalls of the lower section so as to communicate with the passage; and a pair of second outlets disposed in the bottom so as to communicate with the passage, wherein the lower section has ridges horizontally projecting into the passage from inner surfaces of the broad sidewalls between the pair of first outlets, wherein the pair of second outlets are disposed symmetrically about an axis of the tubular body, wherein each of the second outlets has an axis passing therethrough, respectively, and wherein the respective axes that pass through the pair of second outlets cross each other in the passage.

2. The immersion nozzle of claim 1, wherein the ridges are of a substantially rectangular cross section and disposed in opposed relation to each other.

3. The immersion nozzle of claim 2, wherein a/a' ranges from 0.1 to 0.25 and b/b' ranges from 0.15 to 0.35, where a' is a horizontal width of the first outlets; b' is a vertical length of the first outlets; a is a projection height of the ridges; and b is a vertical width of the ridges.

4. The immersion nozzle of claim 3, wherein f/a' ranges from 0.75 to 0.9, e/e' ranges from 0.1 to 0.17, and α ranges from 40° to 60°, where f is a length of the second outlets along the narrow sidewalls; α is an angle formed between each of the axes of the second outlets, respectively, and a horizontal plane; e is a minimum internal measurement between the pair of second outlets; and e' is a width of the passage, along the broad sidewalls, immediately above the first outlets.

5. The immersion nozzle of claim 3, further comprising slits for allowing communication between the first outlets and the second outlets.

6. The immersion nozzle of claim 5, wherein d/a' ranges from 0.2 to 1, where d is a width of the slits.

7. The immersion nozzle of claim 1, wherein the first outlets are vertically elongated slots.

8. The immersion nozzle of claim 1, wherein the respective axes of the pair of second outlets cross each other at a single point in the passage.

9. An immersion nozzle for continuous casting having a tubular body comprising:

a bottom wall;

an inlet disposed opposite the bottom wall;

a passage extending from the inlet to the bottom wall;

a lower section having two opposing narrow sidewalls that adjoin two opposing broad sidewalls, the broad sidewalls being wider than the narrow sidewalls, the narrow and broad sidewalls adjoining the bottom wall of the tubular body, and each narrow sidewall including a first outlet, the first outlets being opposite each other; and two second outlets disposed through the bottom wall so as to communicate with the passage, wherein each broad sidewall includes a ridge that extends laterally from one narrow sidewall to the other narrow sidewall.

10. The immersion nozzle of claim 9, wherein the ridges project toward each other into the passage from inner surfaces of the broad sidewalls, respectively.

11. The immersion nozzle of claim 9, wherein the second outlets are disposed symmetrically about an axis of the tubular body, and wherein an axis of each of the second outlets extends into the passage such that the respective axes of the second outlets intersect at a non-zero angle in the passage.

12. The immersion nozzle of claim 9, wherein the opposite ends of the ridges intersect a central portion of the first outlets, respectively.

13. The immersion nozzle of claim 9, wherein the first outlets extend from above the ridges to below the ridges, such that the first outlets are narrower in a central portion thereof than at opposing ends thereof.

14. The immersion nozzle of claim 9, wherein the ridges project from inner surfaces of the broad sidewalls, respectively, the ridges projecting to a height that is less than half of a width of the passage along the narrow sidewalls such that a space exists across an entire width of the broad sidewalls in the passage between the ridges.

15. The immersion nozzle of claim 9, wherein each narrow sidewall further includes a slit that extends from the first outlet thereon to one of the second outlets.

* * * * *